US005824924A

United States Patent [19]

Agostino

[11] Patent Number: 5,824,924

[45] Date of Patent: Oct. 20, 1998

[54] FIVE POSITION BOW PLAYABLE, ELECTRIC BASS GUITAR

[76] Inventor: Joseph D. Agostino, 1138 Maxum Southard Rd., Howell, N.J. 07731

[21] Appl. No.: 629,472

[22] Filed: Apr. 10, 1996

[51] Int. Cl.[6] ..... G10D 3/00

[52] U.S. Cl. ..... 84/291; 84/327; 84/307

[58] Field of Search ..... 84/327, 291, 275, 84/274, 298, 307, 309, 743

[56] References Cited

U.S. PATENT DOCUMENTS 2,909,092 10/1959 Armond et al. ..... 84/1.15
4,311,078 1/1982 Falgares ..... 84/314 R
5,332,137 7/1994 Violette ..... 224/257
5,339,718 8/1994 Leduc ..... 84/291

*Primary Examiner*—Michael L. Gellner
*Assistant Examiner*—Shih-yung Hsich
*Attorney, Agent, or Firm*—Charles I. Brodsky

[57] ABSTRACT

An electric bass guitar in which its electronic pick-up is displaced substantially 4–4½ inches from its bridge, and in which a plurality of holes are provided within its body to receive a support strap in offering five different playing positions to a user, including one in which the guitar is supported to allow its being bowed without the need for any support stand.

16 Claims, 5 Drawing Sheets

FIVE POSITION BOW PLAYABLE, ELECTRIC BASS GUITAR

FIELD OF THE INVENTION

This invention relates to electric bass guitars, in general, and to those which can additionally be bowed, in particular.

BACKGROUND OF THE INVENTION

Electric bass guitars which can be played using a bowing technique are known in the art. All of them, however, require a stand in which they are inserted, and then played by the musician from a standing position. Their designs also prevent them from being held in the same position as typical electric bass guitars are held and played using traditional fingering techniques.

OBJECTS OF THE INVENTION

It is an object of the present invention, therefore, to provide a new and improved electric bass guitar which avoids these limitations of the prior art.

It is another object of the invention to provide a unique electric bass guitar which can be bowed without the need for any support stand.

It is also an object of the invention to provide an electric bass guitar which can be played using traditional fingering techniques.

It is another object of the invention to provide such an electric bass guitar which can be hung about the shoulder of a player, and which can be bowed while standing.

It is a further object of the invention to allow such an electric bass guitar to be played while sitting, supportable on either leg of the bassist.

It is another object of the invention to provide an electric bass guitar with different, releasable strap positions, so that it can be supported forwardly, to the player's left, in an electric bass guitar position, or rearwardly, to the player's right, in an acoustic bass guitar position.

It is yet one more object of the invention to provide an electric bass guitar which can be played in 5 comfortable positions —2 while standing, 2 while sitting and 1 while standing as the bass guitar is being bowed.

SUMMARY OF THE INVENTION

As will become clear from the following description, the invention provides a new and unique instrument, rather than adding onto existing electric bass guitar designs. As will be seen though, the invention continues to utilize an electronic pick-up, a bridge, a neck over which the strings of the bass guitar are stretched, and a body on which the pick-up controls and bridge are mounted. In accordance with the invention, on the other hand, the body is tapered at its end to form a tail-section, and is provided with a legged-section where the pick-up is secured—a distance of 4–4½ inches above the bridge. As described, the electrical bass guitar of the invention also incorporates a plurality of holes within the body of the guitar, and emplacing straps within these holes to provide different positions in supporting the bass guitar about one's shoulder while playing.

In particular, the preferred embodiment of the invention described provides such holes within the body for emplacing one strap in a support position so as to allow the bowing, picking, and strumming of the guitar in the space so formed between the pick-up and the bridge. There, the holes are provided at locations to allow the guitar to be bowed while hanging vertically in support about the neck of the player while standing. In another usage of the invention to be described, the holes are provided within the body to allow the support of the guitar about a player's neck in a forward, electrical bass guitar playing position while standing, and to allow a different strap emplacement to allow for the support about the neck in rearward, acoustic bass playing position, also while standing. Also to be described in this preferred embodiment is a curvature to the legged body section, so as to allow support of the guitar on either leg of a user playing the guitar while seated.

BRIEF DESCRIPTION OF THE DRAWINGS

These and other features of the invention will be more clearly understood from a consideration of the following description, taken in connection with the accompanying drawing in which.

DETAILED DESCRIPTION OF THE DRAWINGS

Figure 1:
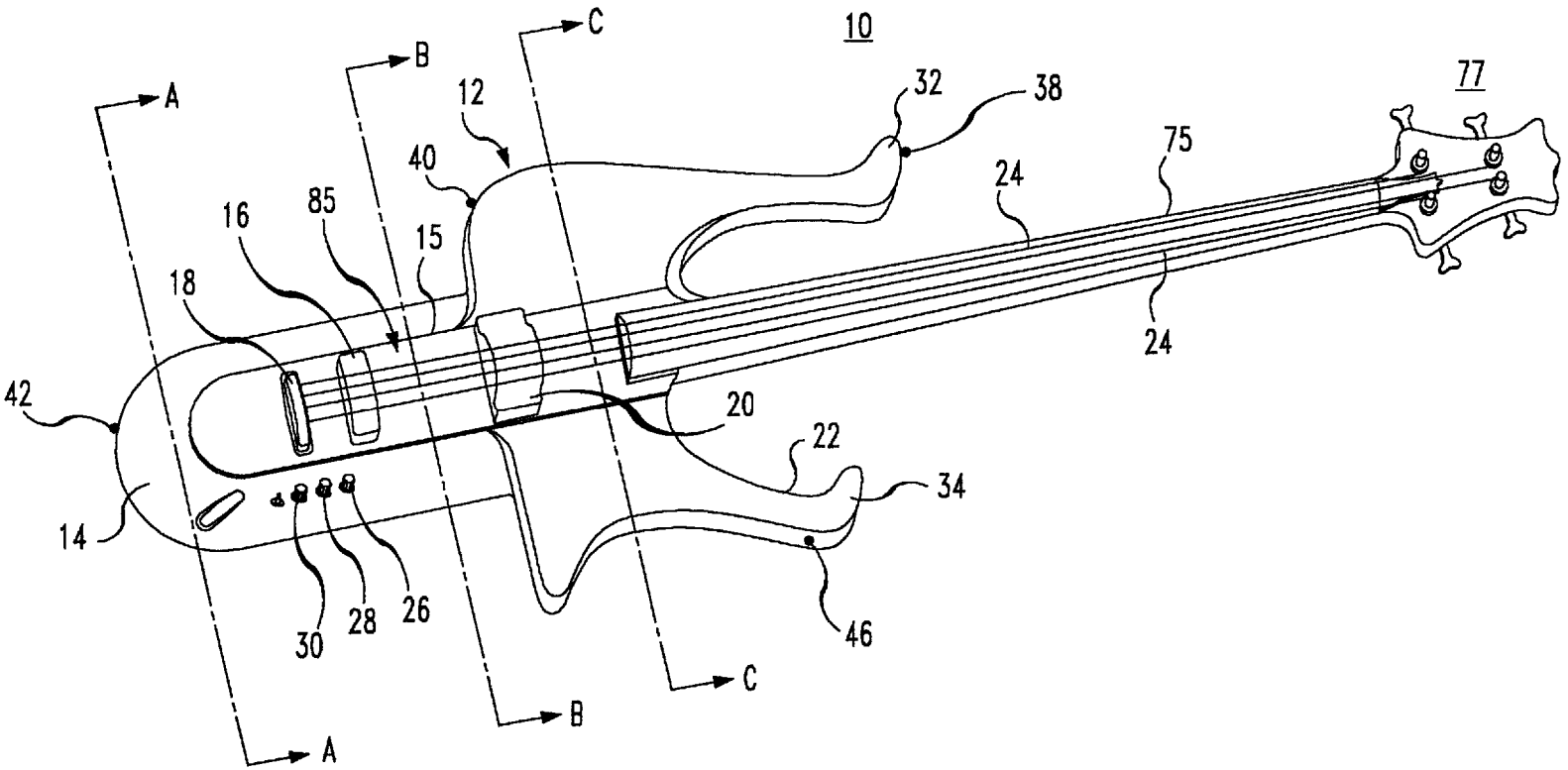
FIG. 1 is a perspective view of a five position bow playable, electric bass guitar embodying the invention.
Figure 2:
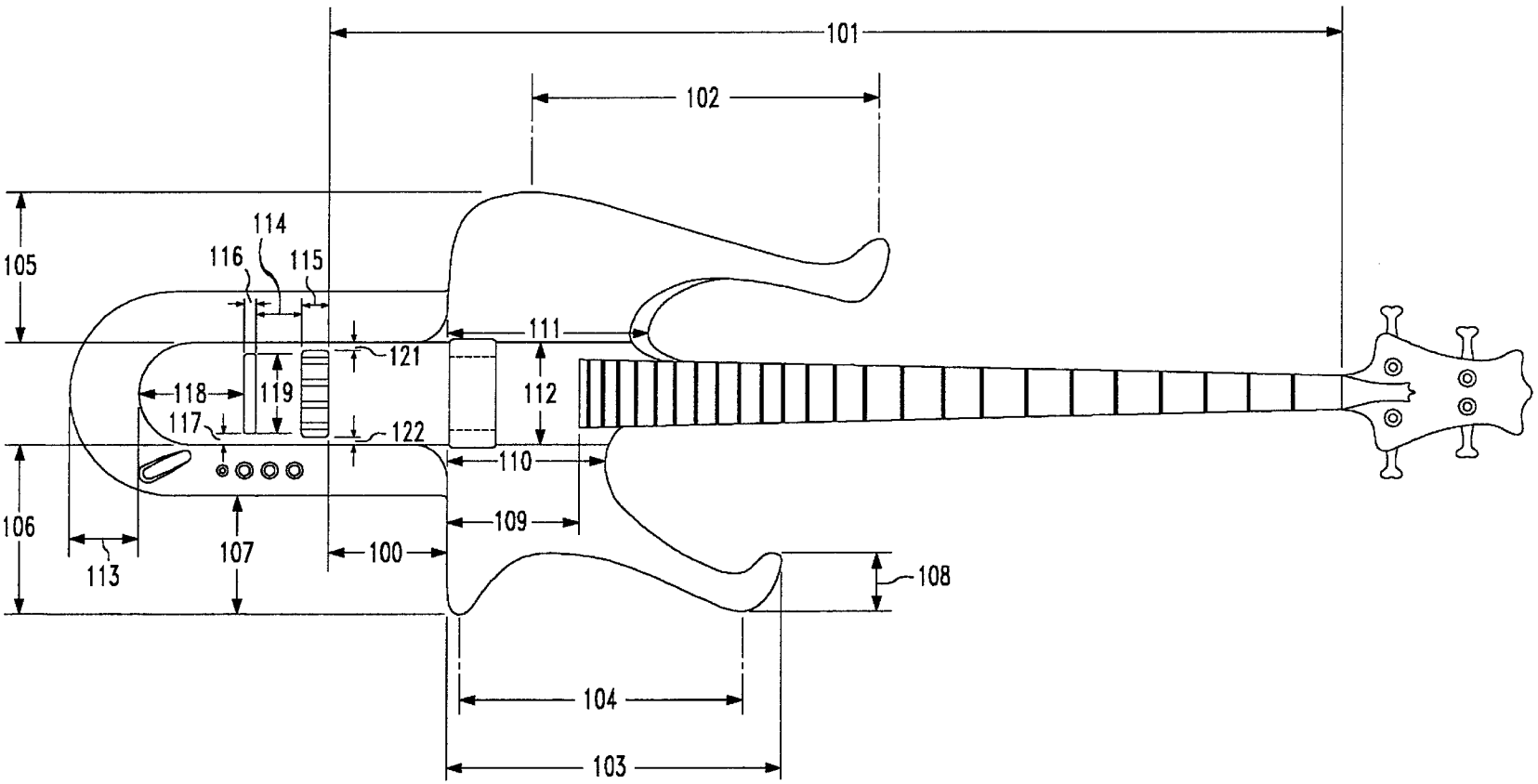
FIG. 2 is a schematic drawing helpful in understanding the different positions attainable with the electric bass guitar of FIG. 1, and in constructing such a unique instrument according to the invention.

Referring to FIGS. 1 and 2, the electric bass guitar 10 includes a body 12 tapered to a tail-section 14 on which is mounted a guitar bridge 16 and a tail piece 18. An electronic pick-up 20 is similarly mounted on a legged-section 22 of the body 12—and as typical, the guitar strings 24 are secured to the tuning hardware 77, and then stretched over the neck 75, the legged-section 22, the pick-up 20 and the bridge 16, to be secured to the tail piece 18. Three control knobs 26, 28, 30 are also shown, for conventionally switching tonal range (26), for adjusting the tone within a range (28) and for adjusting volume (30). As will be understood, the placement of the knobs 26, 28, 30 may be anywhere below the bridge 16, so as not to interfere with the bowing of the strings 24 in the gap between the bridge 16 and the pick-up 20. So as to allow for the guitar 10 to be bowed there, the tail-section 14 is constructed narrower than the legged-section 22, and is tapered away along its outer edge 15, with the bridge 16, to be of a height to provide sufficient clearance in preventing the bow from contacting the body 12, as it is being drawn and played across the strings 24 (see FIGS. 8–10).

In accordance with the invention, furthermore, the electronic pick-up 20 is secured on the legged-section 22 a distance 4–4½ inches away from the bridge 16. Shown as 100 in FIG. 2, such distance spans the tail-section 14, and permits a gap 85 for the guitar to be bowed, comfortably, and to produce a sound which is acoustically correct. Whereas experimentation has found this to be readily attainable for distances between 4 inches and 4½ inches, optimal effects were produced with the spacing being 4½ inches.

Figure 3:
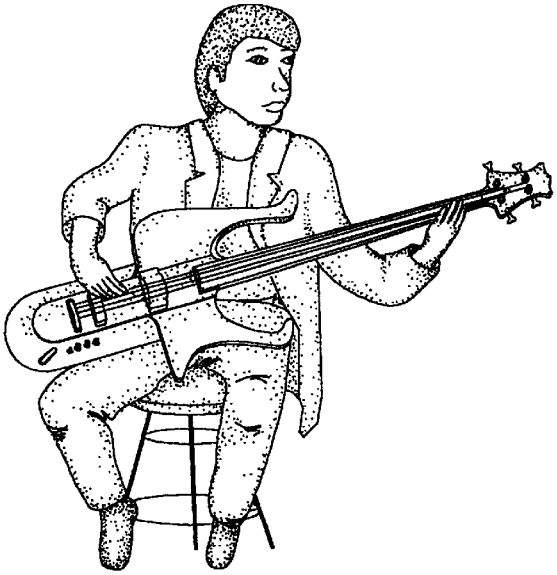
FIGS. 3–7 are views showing the different playing positions obtainable with this invention.
Figure 4:
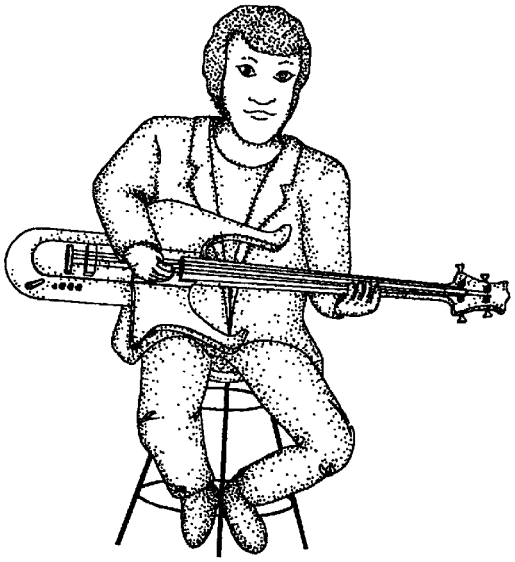

Also shown in FIGS. 1 and 2, the legged-section 22 is provided with an upper leg 32 and with a lower leg 34, the upper leg 32 being of a greater length than the lower leg 34, but with the lower leg 34 having a pronounced curvature to it, which is not present with the upper leg 32. By providing the curvature to the lower leg 34—and by essentially moving the electronic pick-up 20 further away from the guitar bridge 16 than is usually the case with an electric bass guitar—, the guitar of this invention can then be supported by a seated player either on his left leg (FIG. 3) or on his right leg (FIG. 4) comfortably and conveniently. As will thus be appreciated, these two seating arrangements comprise two of the five playable positions of the guitar of the in-vention.

Figure 5:
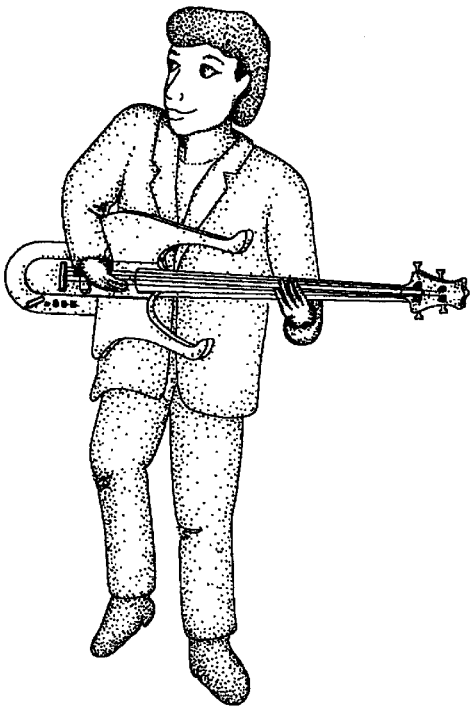
Figure 6:
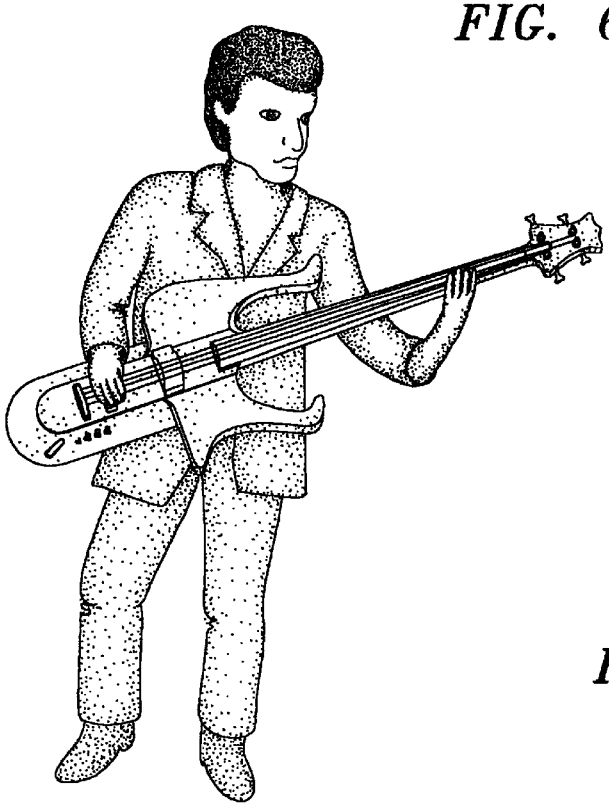
Figure 7:
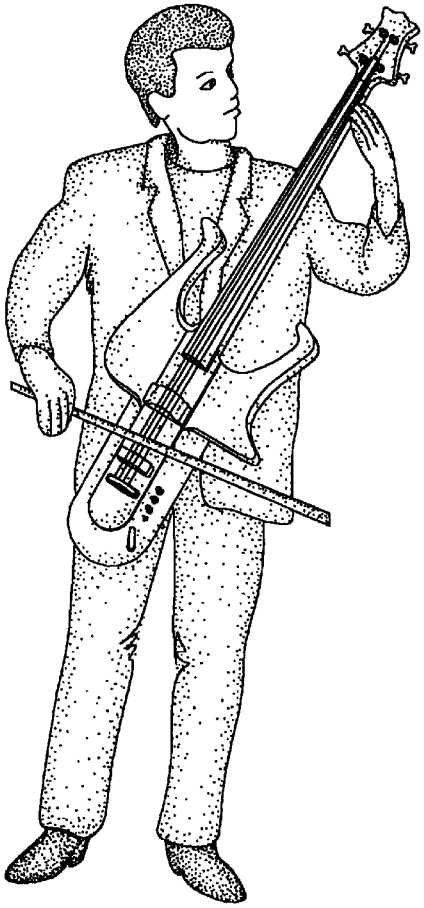

As will be understood from the views of FIGS. 5–7, three other playing positions are available through the further use of strap emplacements according to the invention. In particular, with the inclusion of a strap 36 coupled between points 38 and 40 on the body 12—i.e. the front and rear top positions on the upper leg 32—the electric bass guitar 10 can be supported about the neck of the guitarist in the conventional forward, electric bass guitar position, while the player is standing (FIG. 5). Coupling, instead, a longer strap 37 between the points 38 and 42 on the body 12—i.e. the front top position on the upper leg 32 and the end of the tail section 14—essentially rotates the guitar rearwardly, to the acoustic bass guitar position of the guitarist, again playing while on his feet (FIG. 6). Coupling, however, yet another strap 44 between the points 40 and 46—i.e. the rear top position on the upper leg 32 and the front bottom position on the lower leg 34—will allow the guitar 10 to be draped about the neck of the guitarist, to hang vertically so as to allow the bowing between the bridge 16 and the pick-up 20 while the guitarist is standing, without the need for any support stand being utilized.

Experimentation has shown that points 38, 40, 42 and 46 can be located at different positions about the body 12 based upon comfort and convenience. Experimentation has also shown that there may be any one of a variety of ways of releasably securing the straps 36, 37, 44 into position in hanging the guitar as desired. One particularly attractive way is to drill into the body 12 at the selected points, and then screwing in a metal grommet insert to receive the ends of a strap having a push-button interlock that secures with the grommet. Obviously, other types of securements can be had as well as various dimensionings for the component parts of the guitar 10 of the invention—and the following have proved especially useful for the construction of the guitar 10, as shown in FIG. 2:

Dimension 101 . . . 34 inches
Dimension 102 . . . 13 inches
Dimension 103 . . . 10¾ inches
Dimension 104 . . . 9 inches
Dimension 105 . . . 6 inches
Dimension 106 . . . 5¼ inches
Dimension 107 . . . 3¾ inches
Dimension 108 . . . 1⅞ inches
Dimension 109 . . . 7⅞ inches
Dimension 110 . . . 5 inches
Dimension 111 . . . 6¾ inches
Dimension 112 . . . 3½ inches
Dimension 113 . . . 1½ inches
Dimension 114 . . . 1⅜ inches
Dimension 115 . . . ⅞ inch
Dimension 116 . . . ⅜ inch
Dimension 117 . . . ⅜ inch
Dimension 118 . . . 2⅞ inches
Dimension 119 . . . 2¾ inches
Dimension 120 . . . 3 inches
Dimension 121 . . . ¼ inch
Dimension 122 . . . ¼ inch
Dimension 100 . . . 4¼ inches Experimentation has further shown that the neck 75, bridge 16, and electronic pick-up 20 should all have a substantially identical arc radius between 2¼ inches and 2¾ inches, with 2½ inches being preferable. Such angulation permits bowing of a single guitar string without accidentally contacting its neighboring strings, yet continues flat enough to allow traditional fingering techniques to be used in playing the electric bass guitar.

Figure 8:
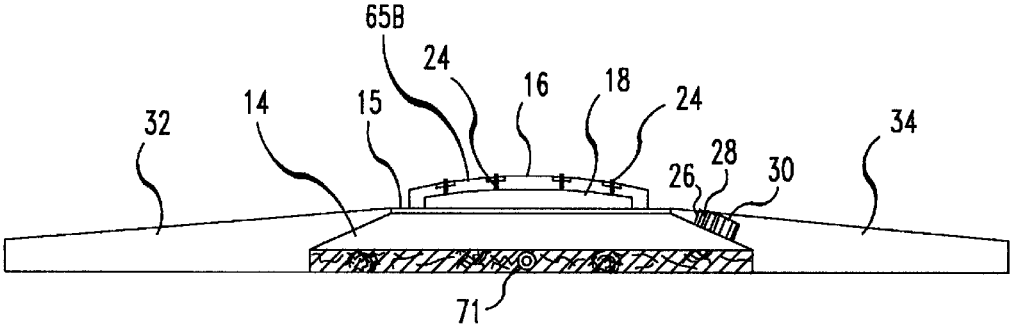
FIGS. 8–10 are sectional views helpful in understanding the bowing and fingering techniques available with the invention.
Figure 9:
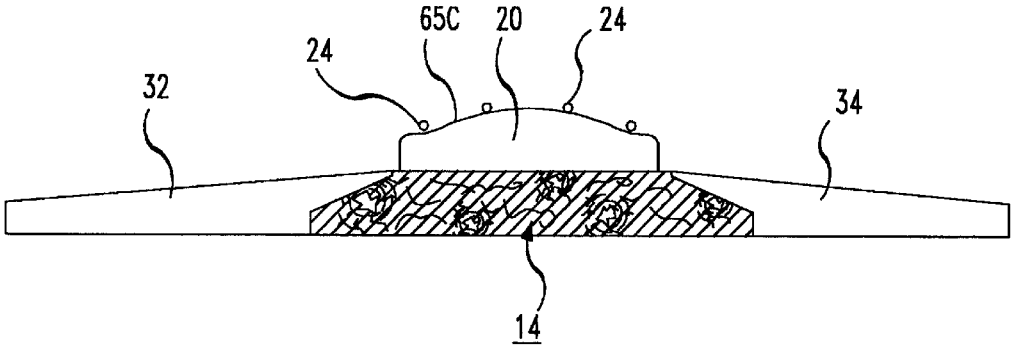
Figure 10:
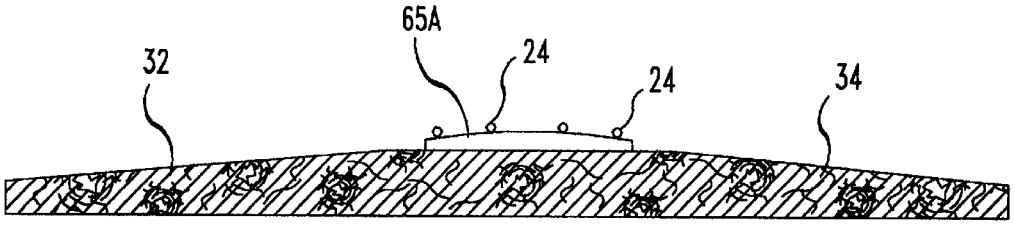

In this respect, FIG. 8 will be understood as representing a sectional view of the electric bass guitar taken along the line A—A of FIG. 1, the audio output jack for the guitar being shown at 71. The bridge 16, the tail piece 18 and the guitar strings 24 are as indicated, as well as the taper 15 of the tail-section 14. FIG. 9 then represents a sectional view of the guitar taken along the line B—B of FIG. 1, showing the upper and lower legs 32 and 34, the electronic pick-up 20 and the guitar strings 24. FIG. 10 is a sectional view of the guitar taken along the line C—C of FIG. 1 showing the legs 32 and 34, the neck 75 of the guitar, and the strings 24. The arc radius for the neck 75, the bridge 16, and the pick-up 20 are indicated by the notations 65*a*, 65*b*, and 65*c*, respectively, and, as set forth above, are preferably equal. As will be understood, the guitar 10 can thus be picked, strummed or bowed—and by a musician who is seated, standing or moving about on a stage.

While there have been described what are considered to be preferred embodiments of the present invention, it will be readily appreciated by those skilled in the art that modifications can be made without departing from the scope of the teachings herein. For at least such reasons, therefore, resort should be had to the claims appended hereto for a true understanding of the invention.

I claim:

1. In an electric bass guitar of the type having a neck, tuning hardware, an electronic pick-up, a bridge over which strings of the guitar are stretched and a tail piece to which said strings are secured, the improvement comprising:

a) a body including a tail-section on which said tail piece and said bridge are mounted, and a legged-section having upper and lower legs on which said electronic pick-up is mounted;

b) with said legged-section incorporating a rear wall from which said upper and lower legs extend forwardly, and with said tail-section being narrower than said legged-section and ex-tending perpendicularly from said rear wall;

c) with said pick-up being secured on said legged-section a distance at least 4–4½ inches away from said bridge secured on said tail-section;

d) a plurality of holes within said body; and e) a strap for insertion within said holes to provide different positions to support said body about one's neck while playing said guitar;

f) with said tail-section being of a predetermined length with outwardly tapering walls, and with said bridge being of a height and arc radius to allow clearance between said strings and said tail-section when said guitar is bowed in the space so formed between said pick-up and said bridge.

2. The improvement of claim 2 wherein said holes are provided within said body to allow said guitar to be bowed by a user playing said guitar while standing.

3. The improvement of claim 2 wherein said holes are provided within said upper and lower legs of said body to allow said guitar to hang vertically when supported about the neck of a player bowing said guitar while standing.

4. The improvement of claim 3 wherein said holes are provided at a rear top position on said upper leg of said legged-section of said body, and at a front bottom position on said lower leg of said legged-section of said body.

5. The improvement of claim 1 wherein said holes are provided within said body for emplacing said strap to allow support of said guitar by a user playing said guitar in a forward, electric bass guitar position while standing.

6. The improvement of claim 5 wherein said holes are provided at front and rear top positions on said upper leg of said legged-section of said body.

7. The improvement of claim 1 wherein said holes are provided within said body for emplacing said strap to allow support of said guitar by a user playing said guitar in a rearward, acoustic bass guitar position while standing.

8. The improvement of claim 7 wherein said holes are provided at a front top position on said upper leg of said legged-section of said body, and at an end of said tail-section of said body.

9. The improvement of claim 1 wherein said lower leg is of a curvature to allow support of said guitar on either leg of a user playing said guitar while seated.

10. The improvement of claim 9 wherein said upper leg is of a first length, wherein said lower leg is of a second length, and wherein said first length is of a greater length than the said second length.

11. The improvement of claim 9 wherein said upper leg is of a first curvature, wherein said lower leg is of a second curvature, and wherein said first curvature is less than said second curvature to allow support of said upper leg on either leg of a user playing said guitar while seated.

12. The improvement of claim 1 wherein said plurality of holes are drilled within said body of said guitar, and wherein said straps are releasably emplaced within said holes by a push-button coupling.

13. The improvement of claim 1 wherein said pick-up on said legged-section is secured a distance substantially 4¼ inches away from said bridge on said tail-section.

14. The improvement of claim 1 wherein said neck, said bridge, and said pick-up are constructed to have substantially equal arc radii.

15. The improvement of claim 14 wherein said neck, said bridge and said pick-up are constructed to have an arc radius between 2¼ and 2¾ inches.

16. The improvement of claim 14 wherein said neck, said bridge and said pick-up are constructed to have an arc radius of 2½ inches.

* * * * *